US007965242B2

(12) United States Patent
Abramov et al.

(10) Patent No.: US 7,965,242 B2
(45) Date of Patent: Jun. 21, 2011

(54) DUAL-BAND ANTENNA

(75) Inventors: Oleg Jurievich Abramov, St. Petersburg (RU); Farid Ibragimovich Nagaev, St. Petersburg (RU); Randy Salo, San Diego, CA (US)

(73) Assignee: Airgain, Inc., Carlsbad, CA (US)

( * ) Notice: Subject to any disclaimer, the term of this patent is extended or adjusted under 35 U.S.C. 154(b) by 1182 days.

(21) Appl. No.: 11/627,796

(22) Filed: Jan. 26, 2007

(65) Prior Publication Data

US 2010/0328163 A1 Dec. 30, 2010

Related U.S. Application Data

(60) Provisional application No. 60/762,644, filed on Jan. 27, 2006.

(51) Int. Cl.
*H01Q 1/24* (2006.01)

(52) U.S. Cl. ..... 343/702; 343/700 MS

(58) Field of Classification Search ..... 343/702, 343/700 MS, 834, 905
See application file for complete search history.

(56) References Cited

U.S. PATENT DOCUMENTS

| | | | | |
|---|---|---|---|---|
| 3,725,938 | A * | 4/1973 | Black et al. | 342/435 |
| 6,232,925 | B1 | 5/2001 | Fujikawa et al. | |
| 7,633,442 | B2 * | 12/2009 | Chiang et al. | 342/432 |
| 2002/0014932 | A1 | 2/2002 | Osadchy et al. | |
| 2002/0019247 | A1 | 2/2002 | Egorov | |
| 2002/0132581 | A1 * | 9/2002 | Ichihara | 455/25 |
| 2004/0027304 | A1 | 2/2004 | Chiang et al. | |
| 2005/0058111 | A1 | 3/2005 | Hung et al. | |
| 2005/0134516 | A1 | 6/2005 | Du | |
| 2010/0328177 | A1 * | 12/2010 | Kemp et al. | 343/834 |

OTHER PUBLICATIONS

International Search Report / Written Opinion dated Oct. 25, 2007 issued in PCT/US07/61154.

* cited by examiner

*Primary Examiner* — HoangAnh T Le
(74) *Attorney, Agent, or Firm* — Procopio, Cory, Hargreaves & Savitch LLP

(57) ABSTRACT

Systems and methods for a dual-band antenna and methods for manufacturing the same are described. One system and method includes a plurality of antenna elements. Groups of the antenna elements cooperate to form directional antennas at various frequencies. Using an active element, configurable at different frequencies and reflectors tuned to different frequencies, directed transmission or direction of positive gain for the antenna system is achieved. The system can be used for various wireless communication protocols and at various frequency ranges.

39 Claims, 7 Drawing Sheets

DUAL-BAND ANTENNA

RELATED APPLICATIONS

This application claims the benefit of U.S. provisional patent application Ser. No. 60/762,644, filed Jan. 27, 2006, entitled "Dual-Band Antenna" which is hereby incorporated by reference in its entirety.

BACKGROUND

1. Field of the Invention

This invention relates to wireless communication systems, in particular, directional antennas for use in wireless communication systems.

2. Background

In wireless communication systems, antennas are used to transmit and receive radio frequency signals. In general, the antennas can be omni-directional, receiving and transmitting signals from any direction, or directional, with reception and transmission of signals limited in direction. In general, directional antennas provided increased gain over an omni-directional antenna because the directional antenna's coverage is focused over a small spatial region. Because a directional antenna covers a limited spatial region, the antenna needs to be "pointed" so that it can transmit and receive signals in a desired direction. Some conventional antenna systems include multiple directional antennas, or elements, arranged in an array such that individual elements "point" in different directions. By selecting desired elements of the array the overall direction of the antenna system can be varied. In addition, there exist antenna systems which provide directive gain with electronic scanning, such as phased arrays, rather than being fixed. However, many such electronic scanning technologies are plagued with excessive loss and high cost. In addition, many of today's wireless communication systems provide very little room for antennae elements.

One type of directional antenna that is popular is traditional Yagi-Uda ("Yagi") antenna. A traditional Yagi antenna includes a driven element, the element a signal is fed to by a transmitter or other signal source, called the driver or antenna element, one or more reflectors, and one or more director elements. The reflector and director elements are parasitic elements that are not driven. By choosing the proper length and spacing of a reflector element from the driven element, as well as the length and spacing of director elements, the induced currents on the reflector and director elements will re-radiate a signal that will additively combine with the radiation from the driven element to form a more directive radiated beam compared to the radiation from the driven element alone. The most common Yagi arrays are fabricated using a dipole for the driven element, and straight wires for the reflector and director elements. The reflector element is placed "behind" the driven element and the director elements are placed in "front" of the driven element. The result is a linear array of wires that together radiate a beam of radio frequency (RF) energy in the forward direction. The directivity, and therefore the gain, of the radiated beam can be increased by adding additional director elements, but at the expense of overall antenna size. The director element can be eliminated, which leads to a smaller antenna with wider beam width coverage compared to Yagi antennas utilizing director elements.

In conventional Yagi antennas, the driven element is a dipole element that has a length that is nominally one-half of a wavelength of the radio frequency (RF) signal transmitted or received by the antenna. The reflector element is usually approximately five percent longer than the dipole and the director elements are approximately five percent shorter than the dipole. The spacing between the elements is critical to the design of the Yagi and varies from one design to another, with element spacing typically varying between one-eighth and one-quarter wavelength. While the Yagi antenna dos provide a relatively simple directional antenna design, the overall size is usually relatively large because of the reflector and director elements and the spacing between the elements.

There is a need in the art for improved antennas that can provide directional gain and are compact in size.

SUMMARY

The present invention includes a method, apparatus and system as described in the claims. In one embodiment, an antenna system includes a dual-band strip line monopole element. The monopole element includes a radio frequency (RF) choke, such as a coplanar waveguide stub, located at one end of the element above a lower portion of the element. The overall length of the monopole element is selected so as to resonate at a first desired frequency. For example, the overall length of the monopole element can be selected to be about a one quarter wavelength of the first desired frequency. The length of the lower portion is selected so as to resonate at a second desired frequency. For example, the length of the lower portion of the monopole element can be selected to be about a one-quarter wavelength of the second desired frequency. The antenna system also includes a first reflector element located at a distance from the monopole element corresponding to a reflective distance of the first desired frequency, wherein a length of the first reflector element is selected so as to resonate at the first desired frequency. For example the distance from the monopole element to the first reflector and the length of the first reflect can be about a quarter wavelength of the first desired frequency. The antenna system includes a second reflector element located between the monopole element and the first reflector, wherein the second reflector element is located at a distance corresponding to a reflective distance of the second desired frequency. The length of the second reflector is selected so as to resonate at the second desired frequency. For example, the distance from the monopole element to the second reflector and the length of the second reflector can be about a quarter wavelength of the second desired frequency.

In another embodiment, an antenna system includes a first and a second dual-band strip line monopole elements, and each monopole element includes an RF chock, such as a coplanar waveguide stub, located at one end of the element above a lower portion of the element, An overall length of the monopole element is selected so as to resonate at a first desire frequency, for example, the overall length of the monopole element can be selected to be about a one quarter wavelength of the first desired frequency. A length of the lower portion of the monopole element is selected so as to resonate at a second desired frequency, for example, the length of the lower portion of the monopole elements can be selected to be about a one-quarter wavelength of the second desired frequency. The antenna system also includes a common reflector element located between the first and second monopole elements. The common reflector is located at a reflective distance of the first desired frequency from each of the first and second monopole elements. A length of the common reflector element is selected so as to resonate at the first desired frequency, for example the length of the common reflector is selected to be about a quarter wavelength of the first desired frequency. The antenna system includes a first and a second reflector elements, wherein the first reflector element is located between the first monopole element and the common reflector and the second reflector element is located between the second monopole element and the common reflector. The first and second reflector elements are each located at a distance from the first and second monopole elements corresponding to a reflective distance of the second desired frequency. In addition, each of the first and second reflector elements has a length selected so as to resonate at the second desired frequency. For example, the length of the first and second reflectors can be selected to be about a quarter wavelength of the second desired frequency.

In the embodiments of the antenna systems, a ratio of the second desired frequency to the first desired frequency can be a non-integer value. For example, if the monopoles include an RF chock, such as a quarter wavelength choke or a coplanar stub, then the ratio of the second desired frequency to the first desired frequency can be greater than about 2. In another embodiment, if a lumped RF choke is used then the ratio of the second desired frequency to the first desired frequency can be less than about 2. In one embodiment, the first desired frequency is about 2.4 GHz and the second desired frequency is about 5 GHz.

The antenna system can be implemented on a supporting structure, for example, a cardbus card, or a PCMCIA card.

A method of varying a beam pattern of an antenna includes having a first dual-band strip line monopole element reflectively coupled to a first and second reflector and a second dual-band strip line monopole element reflectively coupled to the first and a third reflector. Applying a first signal at a desired frequency to the first dual-band strip line monopole element, wherein the frequency of the signal is selected to cooperate with, and reflect from one of the first and second reflectors to thereby radiate a radio frequency signal in a first direction, and applying a second signal at a desired frequency to the second dual-band strip line monopole element, wherein the frequency of the signal is selected to cooperate with, and reflect from one of the third reflector to thereby radiate a radio frequency signal in a second direction.

In one embodiment, a wireless communication device can include a dual-band antenna having a first monopole element reflectively coupled to a first reflector and a second monopole element reflectively coupled to a second reflector; wherein the first monopole element and first reflector are configured to form a radio frequency beam pattern in a first direction and the second monopole element and second reflector are configured to form a radio beam pattern in a second direction. The wireless communication device also includes a radio module configured to transmit and receive radio frequency signals, and a switch configured to controllable couple the radio module to the first or the second monopole elements.

In another embodiment, a wireless communication device includes a dual-band antenna having a first monopole element reflectively coupled to a first reflector and a second monopole element reflectively coupled to a second reflector; wherein the first monopole element and first reflector are configured to form a radio frequency beam pattern in a first direction and the second monopole element and second reflector are configured to form a radio beam pattern in a second direction. The wireless communication device also includes a radio module comprising a plurality of radios, wherein a first radio is communicatively coupled to the first monopole element and a second radio is communicatively coupled to the second monopole element.

Other features and advantages of the present invention will become more readily apparent to those of ordinary skill in the art after reviewing the following detailed description and accompanying drawings.

BRIEF DESCRIPTION OF THE DRAWINGS

These and other aspects, advantages and details of the present invention, both as to its structure and operation, may be gleaned in part by a study of the accompanying drawings, in which like reference numerals refer to like parts. The drawings are not necessarily to scale, emphasis instead being placed upon illustrating the principles of the invention.

DETAILED DESCRIPTION

Certain embodiments as disclosed herein provide for systems, methods, and apparatuses for a wireless communication device having a multi-beam, multi-band antenna and methods for manufacturing the same. For example one system and method described herein provides a plurality of antenna elements where one or more elements are active and other elements form reflectors for the one or more active elements. As described, the active elements and reflector cooperate to create directed transmissions, or direction of positive gain for the antenna system, at one or more frequency bands. The system can be used for various wireless communication protocols and at various frequency ranges. For example, the system can be used at frequency ranges and having bands centered around 2.4 Ghz, 5.0 Ghz, or other desired frequency bands.

After reading this description it would become apparent to one skilled in the art how to implement the invention in various alternative embodiments and alternative applications. However, although various embodiments of the present invention will be described herein, it is to be understood that these embodiments are presented by way of example only, and not limitations. As such, this detailed description of various embodiments should not be construed to limit the scope or breadth of the present invention. In the description that follows, an example is described for a dual-band antenna that has two main directions of transmission and operates at two primary radio frequency (RF) frequencies. It is noted that the invention is not limited to two directions of transmission nor two frequency bands, and this example is merely used to illustrate aspects and features of the invention. Thus, the aspects and features described can be used to implement any desired number of directions and any desired number of frequency bands.

Figure 1:
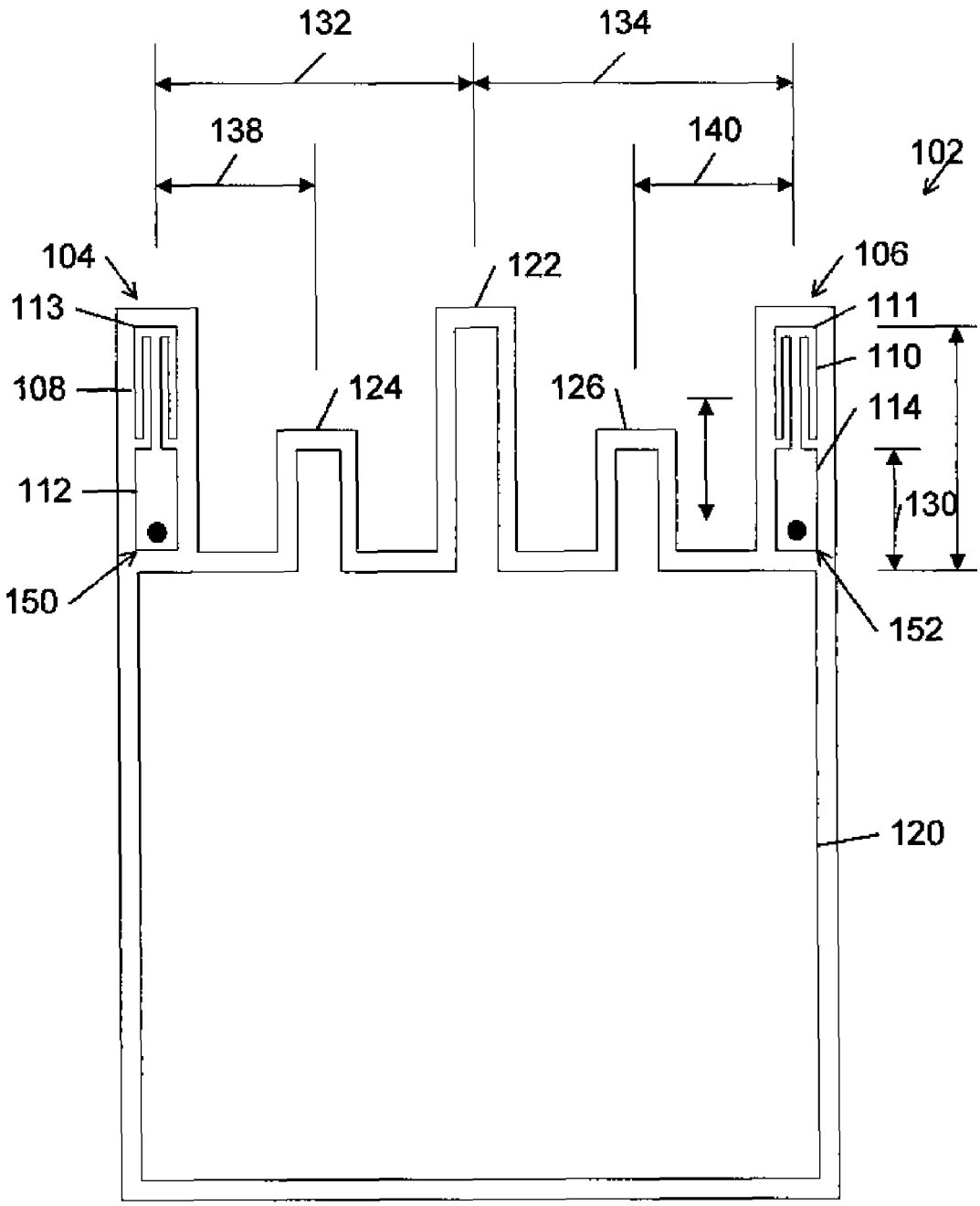
FIG. 1 is a diagram illustrating an example embodiment of a dual-band antenna.

FIG. 1 is a diagram illustrating an example of a dual-band antenna 102. The dual-band antenna 102 includes two dual-band strip line monopole antenna elements 104 and 106. The overall length of the monopoles 104 and 106 is chosen to make them resonate at a first desired frequency. In one embodiment, the overall length of the monopoles 104 and 106 are a resonate length for a 2.4 GHz wavelength RF signal. In one embodiment, each of the dual-band monopoles 104 and 106 is configured to include an RF choke. For example, each monopole 104 and 106 may include a one quarter-wavelength, at 5 GHz, coplanar waveguide stub 108 and 110 with a shorted end 111*a* and 113 located above a lower portion 112 and 114 of the monopole 104 and 106 with the length of the lower portions 112 and 114 being a resonate length of a second desired frequency, for example, a length of one quarter of a wave length at 5 GHz. In another embodiment, each monopole 104 and 106 may include a lumped RF choke, or a short-circuited quarter wavelength coaxial or microstrip stub.

In one embodiment, because the RF chokes, such as coplanar waveguide stubs, 108 and 110 have capacitive impedance at 2.5 GHz, the monopoles 104 and 106 may be a bit shorter than a quarter of wavelength at 2.4 GHz. In one example, the monopoles 104 and 106 are approximately 20% shorter that a quarter wavelength at 2.4 GHz. As noted, the chokes, or stubs, 108 and 110 are located about a quarter of a wavelength 130 above a ground plane 120. The width and length of the monopoles 104 and 106 can be selected to achieve a desired impedance. In one embodiment, the monopoles 104 and 106 width and length can be selected to achieve an impedance close to 50 Ohms at 2.4 and 5 GHz.

In the example of FIG. 1, the dual-band antenna 102 includes a common reflector 122 located between the two monopoles 104 and 106. The location and shape of the common reflector 122 is chosen to decouple the monopoles 104 and 106 at the first desired frequency. For example, the distance 132 and 134 between the common reflector 122 and each of the two monopoles 104 and 108 may be selected to be a reflective distance at the desired frequency. In one embodiment, the location and shape of the common reflector are selected to decouple the monopoles 104 and 106 at 2.4 GHz. In other words, the common reflector 122 is configured to have a length and shape selected so that it resonates at 2.4 GHz. The common reflector 122 keeps the energy radiated by one of the monopoles from reaching the other monopole. In one embodiment, the top portion of the common reflector 122 could have its shape changed, for example it could be made thicker, thereby allowing the overall length of the common reflector 122 be reduced.

In one embodiment, the distance 132 and 134 between the common reflector and each of the two monopoles 104 and 108 may be approximately a quarter of a wavelength at 2.4 GHz. The length 136 of the common reflector 122 can be a resonate length at the first desired frequency, for example, about a quarter of a wavelength at 2.4 GHz.

The example dual-band antenna 102 illustrated in FIG. 1 also includes two reflectors 124 and 126 located between the monopoles 104 and 106 and the common reflector 122. In one embodiment, the shape of the two reflectors 124 and 126 are selected to resonate at the second desired frequency and the two reflectors are located at a reflective distance of the second frequency from the respective monopole 104 and 106. For example, the two reflectors 124 and 126 may be a resonate length for a 5 GHz RF signal and they maybe located between the common reflector 122 and each of the monopoles 104 and 106 and at a reflective distance of 5 GHz from each of the respective monopoles 104 and 106. For example, the distancel38 and 140 between each of the reflectors 124 and 126 and the nearest monopole 104 and 106 respectively, may be a reflective distance at the second desired frequency, for example, about a quarter of wavelength at 5 GHz. The length of the reflectors 124 and 126 may be selected to resonate at the second desired frequency, for example, a length of about quarter of wavelength at 5 GHz.

In one embodiment, a coplanar waveguide stub is included at the end of the common reflector 122. including a coplanar waveguide stub at the end of the common reflector 122 adapts the common reflector 122 into a dual-band reflector. In this case, the lower portion of each monopole, that resonates, for example at 5 GHz, will have two reflectors instead of one. This configuration may increase the antenna gain at 5 GHz.

In the example of FIG. 1 the dual-band antenna 102 has a first and a second RF input, 150 and 152 providing an RF connection to each of the monopoles 104 and 106 respectively. Separate RF inputs provide several advantages. For example, having separate RF inputs eliminate the need for an antenna switch. Also, with separate RF inputs 150 and 152 the two monopoles 104 and 106 can be operated simultaneously.

As discussed further below, each RF input 150 and 152 can provide a separate antenna beam. Providing separate antenna beams provides many advantages. For example, the dual-band antenna 102 can be used in multiple input multiple output (MIMO) communication devices, such as a diversity-switched antenna in a 2×2 MIMO.

The dual-band antenna 102 concept illustrated in FIG. 1 can be used to implement dual-band antennas when the ratio of operating frequencies used (high frequency/low frequency) is not an integer value. Typically, it is difficult to build dual-band antennas with operating frequencies that are non-integer ratios. The dual-band antenna 102 of FIG. 1 is applicable to many high-to-low frequency ratios. For example, when the monopole includes an RF choke, such as a quarter wavelength coke or a coplanar stub, then the ratio can be greater than about 2. In another embodiment, if a lumped RF choke, which may be physically smaller than a quarter wavelength, is used then the ratio of the second desired frequency to the first desired frequency can be less than about 2. One aspect is that the effective length of the monopole at low frequency, typically should not be shorted than a half wavelength of the higher frequency.

Figure 2:
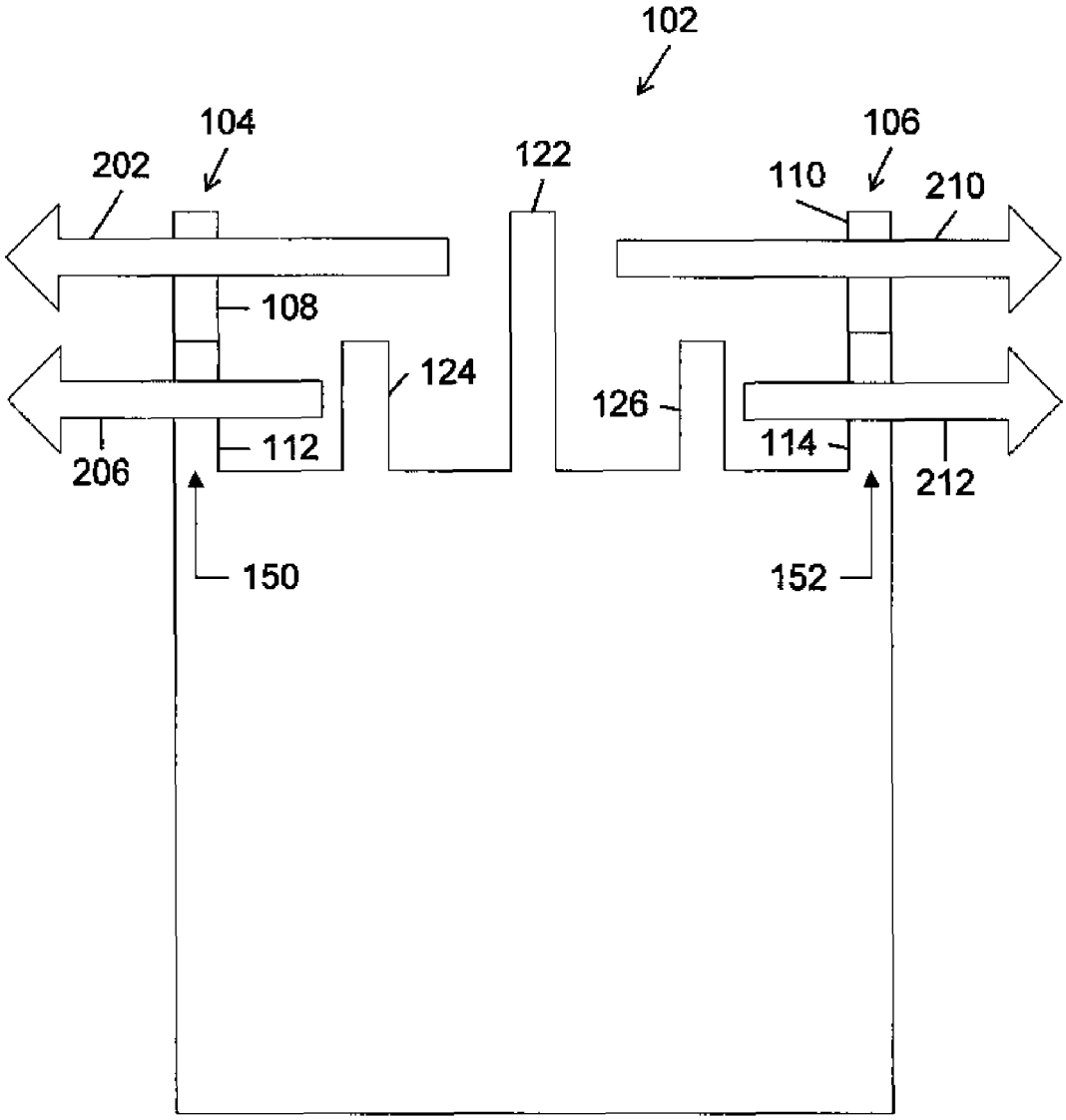
FIG. 2 is a diagram illustrating directional beam patterns of the example dual-beam antenna of FIG. 1.

FIG. 2 is a diagram illustrating directional beam patterns of the example dual-beam antenna 102 of FIG. 1. As shown in FIG. 2, if an RF signal at the first desired frequency is fed into the first RF input 150 then the first monopole 104 and the common central reflector 122 will resonate. Similarly to a two element Yagi antenna, the first monopole 104 and the common central reflector 122 will cooperate to produce an antenna beam pattern at the first desired frequency, generally, to the left of the dual-band antenna 102. The reflector 124 located between the first monopole 104 and the common reflector 122 does not resonate at the first desired frequency because its length was selected to be a resonate length at the second desired frequency, and therefore has minimal impact on the antenna beam pattern 202.

If an RF signal at the second desired frequency is fed to the first RF input 150 then only the lower portion 112 of the monopole 104 will resonate because the upper portion of the monopole 104 is a coplanar waveguide stub 108 that has a very high impedance at the second desired frequency and isolates the stub 108. For example, in one embodiment, the input impedance of the coplanar waveguide stub 108 very high at 5 GHz. This high impedance at 5 GHz isolates the top portion of the monopole from the bottom portion of the monopole at 5 GHz.

Again, similarly to a two element Yagi antenna, the lower portion 112 of the monopole 104 and the reflector 124 located between the first monopole 104 and the common reflector 122 will cooperate to produce an antenna beam pattern 206 at the second desired frequency, generally, to the left of the dual-band antenna 102. The common reflector 122 does not resonate at the second desired frequency because its length was selected to be a resonate length at the first desired frequency, and therefore has minimal impact on the antenna beam pattern 206.

In a similar manner, an RF signal at the first desired frequency that is fed into the second RF input 152 will produce an antenna beam pattern 210 at the first desired frequency, generally, to the right of the dual-band antenna 102. Also, an RF signal at the second desired frequency fed into the second RF input 152 will produce an antenna beam pattern 212 at the second desired frequency, generally, to the right of the dual-band antenna 102

In one embodiment of the example illustrated in FIG. 2, a 2.4 GHz RF signal is fed to the first RF input 150 and, because of their selected shapes, the first monopole 104 and the common central reflector 122 will resonate. Similarly to a two element Yagi antenna, because the common reflector is located at a reflective distance for a 2.4 GHz signal from the monopole 104, the common central reflector 122 will cooperate to produce a 2.4 GHz RF beam pattern 202 radiating, generally, to the left of the dual-band antenna 102. The reflector 124 located between the first monopole 104 and the common reflector 122 is a size selected to resonate at 5 GHz, so it does not resonate at 2.4 GHz, for example because it is too short, and therefore has minimal impact on the radiate RF beam 202.

If a 5 GHz RF signal is fed to the first RF input 150 then only the lower portion 112 of the monopole 104, which has a resonant size for a 5 GHz signal, will resonate because the upper portion of the monopole 104 is an RF choke, such as a coplanar waveguide stub, 108 that has a very high impedance at 5 GHz and isolates the stub 108. Again, similarly to a two element Yagi antenna, the lower portion 112 of the monopole 104 and the reflector 124 located between the first monopole 104 and the common reflector 122 that is a size selected to resonate at 5 GHz, will cooperate to produce a 5 GHz RF beam pattern 206 radiating, generally, to the left of the dual-band antenna 102. The common reflector 122 that is a resonate size for a 2.4 GHz signal does not resonate at 5 GHz, for example because it is too long, and therefore has minimal impact on the radiate RF beam 206.

In a similar manner, a 2.4 GHz RF signal fed into the second RF input 152 will produce a 2.4 GHz RF beam pattern 210 radiating, generally, to the right of the dual-band antenna 102. Also, a 5 GHz signal fed into the second RF input 152 will produce a 5 GHz RF beam pattern 212 radiating, generally, to the right of the dual-band antenna 102

As illustrated in FIG. 2, the directional pattern of the dual-band antenna 102 has two sets of opposite beams. Each set of opposite beams can be formed on both frequencies simultaneously. In addition, both sets may be formed simultaneously. Thus, in the example shown in FIG. 2, a 2.4 GHz beam 202 and a 5 GHz beam 206 can be formed radiating to the left, and a 2.4 GHz beam 210 and a 5 GHz beam 212 can be form radiating to the right, all at the same time as well as any combination of the four beams.

While the example illustrated in FIG. 2 describes applying RF signals to the RF inputs 150 and 152 and RF beam patterns radiating from the dual band antenna, such as signals being transmitted from the antenna, similar patterns can be used to receive signals by the dual-band antenna 102. For example, if an 2.4 GHz RF signal is received from the left of the dual-band antenna 102, the monopole 104 and the common central reflector 12 will cooperate to induce a 2.4 GHz RF current in the monopole 104 that can be sensed at the first RF input 150. Likewise, if an 5 GHz RF signal is received from the left of the dual-band antenna 102, the bottom portion 112 of the monopole 104 and the 5 GHz reflector 124 will cooperate to induce a 5 GHz RF current in the monopole 104 that can be sensed at the RF input 150. In a similar manner, 2.4 GHz and 5 GHz signals can be received from the right of the dual-band antenna and produce RF currents in the second RF input 152.

The discussion above described an antenna that operates at two different frequencies and antenna patterns that are opposite each other. Other configurations of frequencies and patters are possible. For example, different configurations of monopoles and reflectors can operate at different frequencies. Likewise, different arrangements of monopoles and reflectors can produce various beam patterns. In addition, other configurations can operate at more than two different frequencies.

The dual-band antenna described herein can be used with many different radio systems. For example, the antenna system can be combined with the systems described in U.S. patent application Ser. No. 11/209,358, filed Aug. 22, 2005 entitled "Optimized Directional Antenna System", assigned to the assignee of the present application and hereby incorporated by reference in its entirety. The dual-band antenna described can also be used in MIMO applications, and other applications where an antenna that can provide directionality and operate at multiple frequencies would be useful.

Figure 3:
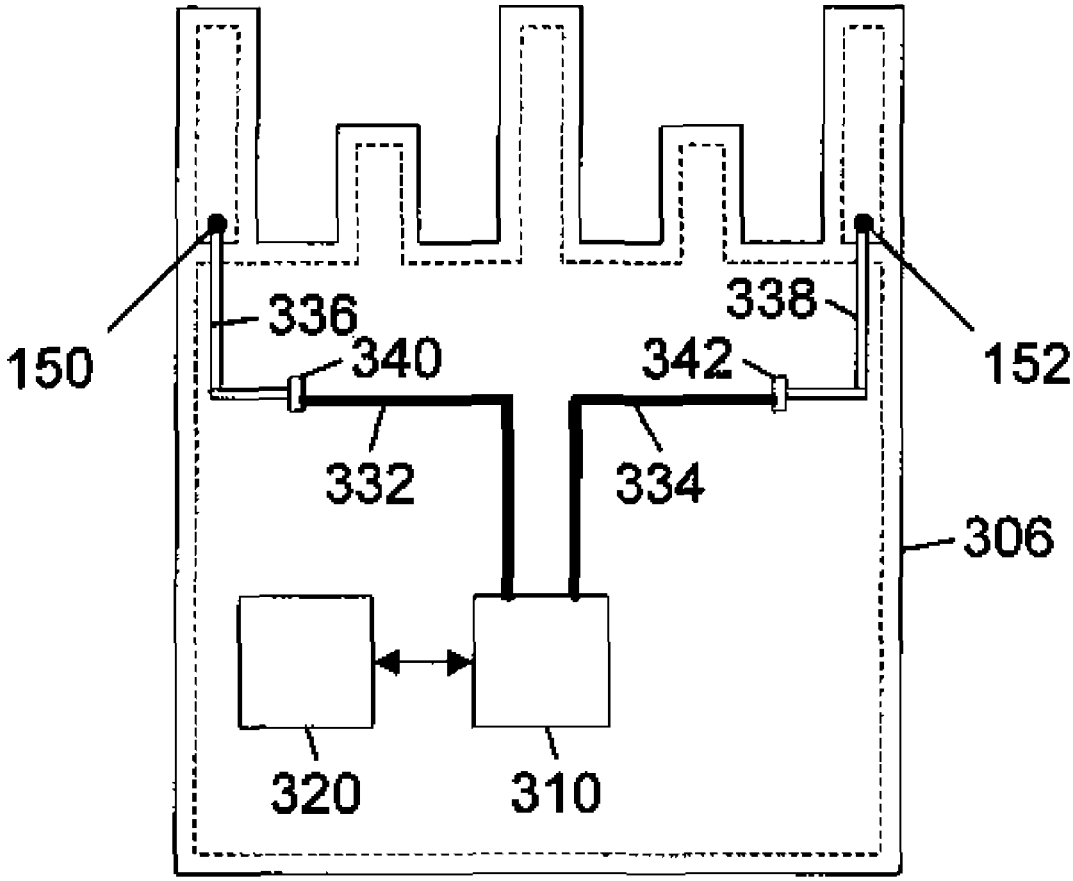
FIG. 3 is a diagram illustrating a dual-band antenna system located on a supporting structure.

The dual-band antenna can also be located on many different support structures. For example, the dual-band antenna can be located on a Cardbus card, or a PCMCIA card. FIG. 3 is a diagram illustrating a dual-band antenna system located on a supporting structure. FIG. 3 illustrates a front view of a supporting structure 306, for example, a printed circuit board, such as a Cardbus card or a PCMCIA card. In the example of FIG. 3, the ground plane and dual-band antenna are located on the back side of the card 306 as indicated by the dashed lines. In one embodiment, the support structure, or card, 306 includes the elements or components of a wireless network card including a radio 310 and a controller 320 which are located on the printed circuit board. In one example, the radio may be coupled to the first and second RF feeds 150 and 152 via microstrip lines, strip lines, or coaxial cables, 332 and 334 which are coupled to corresponding strip lines 336 and 338 at connectors 340 and 341. A first strip line 336 runs from a first connector 340 to the first RF input 150. A second strip line 388 runs from the second connector 342 to the second RF input 152.

Figure 4:
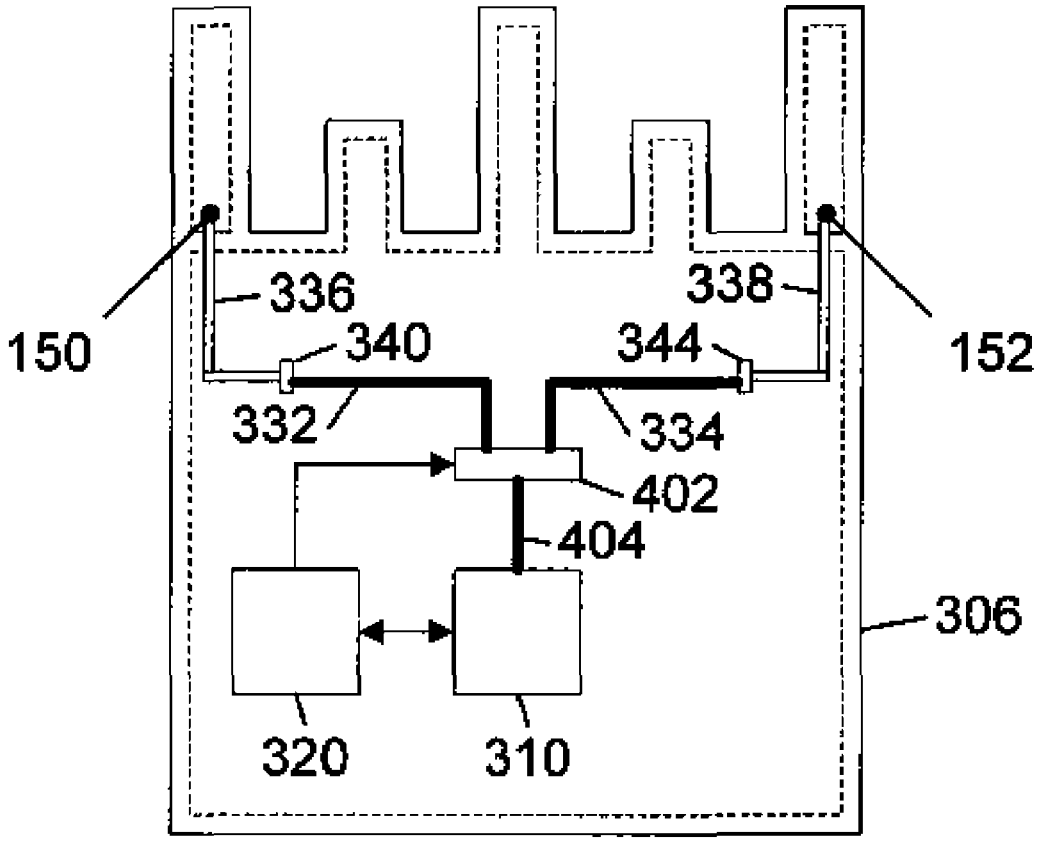
FIG. 4 is diagram illustrating another example of a dual-band antenna system located on a supporting structure.

FIG. 4 is diagram illustrating another example of a dual-band antenna system located on a supporting structure. FIG. 4 is similar to FIG. 3, with the addition of an antenna switch 402. In the example of FIG. 4, the radio 310 is coupled to the switch 402 via a coaxial cable 404. The switch 402 can be controlled by the controller 320 to selectively couples the radio to either the left side of the dual band antenna via microstrip lines, strip lines, or coaxial cable, 332, connector 340 and strip line 336, or the right side of the dual band antenna via microstrip line, strip line, or coaxial cable, 334, connector 344 and strip line 338.

Figure 5:
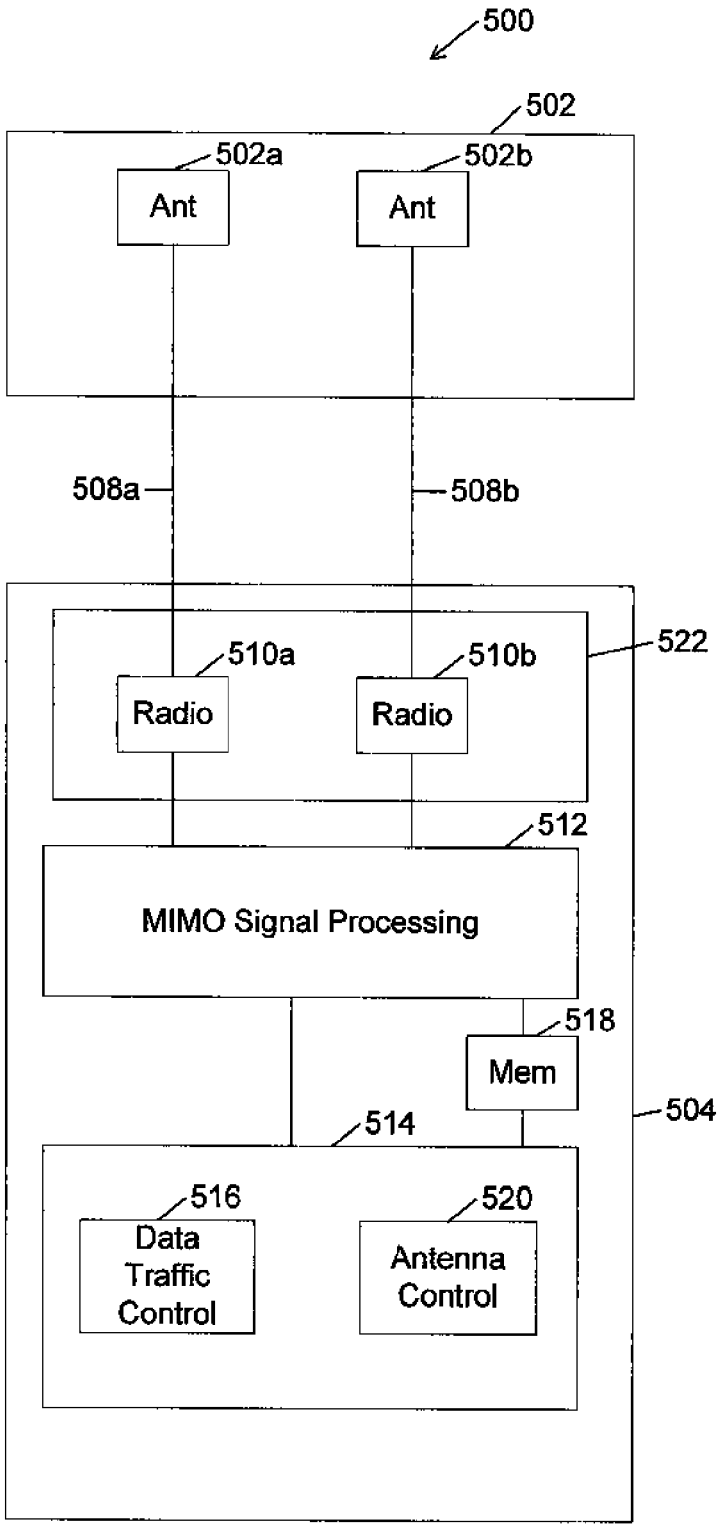
FIG. 5 is a functional block diagram of an embodiment of a wireless communication device that may use a dual-band antenna, such as the dual-band antenna illustrated in FIG. 1.

FIG. 5 is a functional block diagram of an embodiment of a wireless communication device 500 that may use a dual-band antenna, such as the dual-band antenna illustrated in FIG. 1. The wireless device 500 can be, for example, a wireless router, a mobile access point, a wireless network adapted, or other type of wireless communication device. In addition, the wireless device can employ MIMO (multiple-in multiple-out) technology. The communication device 500 includes a dual-band antenna system 502 which is in communication with a radio system 504. In the example of FIG. 5, the dual-band antenna includes a first portion 502*a* that radiates in a first direction and a second portion 502*b* that radiates in a second direction different that the first direction. In the example illustrated in FIG. 5, the dual-band antenna radiates in two different directions, in other embodiments, the dual-band antenna may be configured to radiate in more than two directions.

The radio system 504 includes a radio sub-system 522. In the example of FIG. 5, the radio sub-system 522 includes two radios 510*a* and 510*b*. In other configurations different numbers of radios 510 may be included. The radios 510*a* and 510*b* are in communication with a MIMO signal processing module, or signal processing module, 512. The radios 510*a* and 510*b* generate radio signals which are transmitted by the dual-band antenna system 502 and receive radio signals from the antenna system. In one embodiment each directional portion 502*a* and 502*b* are coupled to a single corresponding radio 510*a* and 510*b*. Although each radio is depicted as being in communication with a corresponding portion of the dual-band antenna by a transmit and receive line 508*a* and 508*b*, more or fewer such lines can be used. In addition, in one embodiment the radios can be controllably connected to various portions of the dual-band antenna by multiplexing or switching.

The signal processing module 512 implements the MIMO processing. MIMO processing is well known in the art and includes the processing to send information out over two or more radio channels using the dual-band antenna system 502 and to receive information via multiple radio channels and antennas as well. The signal processing module can combine the information received via the multiple antenna into a single data stream. The signal processing module may implement some or all of the media access control (MAC) functions for the radio system and control the operation of the radios so as to act as a MIMO system. In general, MAC functions operate to allocate available bandwidth on one or more physical channels on transmissions to and from the communication device. The MAC functions can allocate the available bandwidth between the various services depending upon the priorities and rules imposed by their QoS. In addition, the MAC functions operate to transport data between higher layers, such as TCP/IP, and a physical layer, such as a physical channel. The association of the functions described herein to specific functional blocks in the figure is only for ease of description. The various functions can be moved amongst the blocks, shared across blocks and grouped in various ways.

A central processing unit (CPU) 514 is in communication with the signal processor module 512. The CPU 514 may share some of the MAC functions with the signal processing module 512. In addition, the CPU can include a data traffic control module 516. Data traffic control can include, for example, routing associated with data traffic, such as a DSL connection, and/or TCP/IP routing. A common or shared memory 518 which can be accessed by both the signal processing module 512 and the CPU 514 can be used. This allows for efficient transportation of data packets between the CPU and the signal processing module.

A signal quality metric for each received signal and/or transmitted signal on a communication link can be monitored to determine which portion of the dual-band antenna system 502 is preferred, for example, which direction it is desired to radiate or receive RF signals. The signal quality metric can be provided from the MIMO signal processing module 512. The MIMO signal processing module has the ability to take into account MIMO processing before providing a signal quality metric for a communication link between the wireless communication device 500 and a station with which the wireless communication device is communicating. For example, for each communication link the signal processing module can select from the MIMO techniques of receive diversity, maximum ratio combining, and spatial multiplexing each. The signal quality metric received from the signal processing module, for example, data through put or error rate, can vary based upon the MIMO technique being used. A signal quality metric, such as received signal strength, can also be supplied from one or more of the radios 510*a* and 510*b*. The signal quality metric can be used to determine or select which portions of the dual-band antenna and which frequency it is desired to use.

Figure 6:
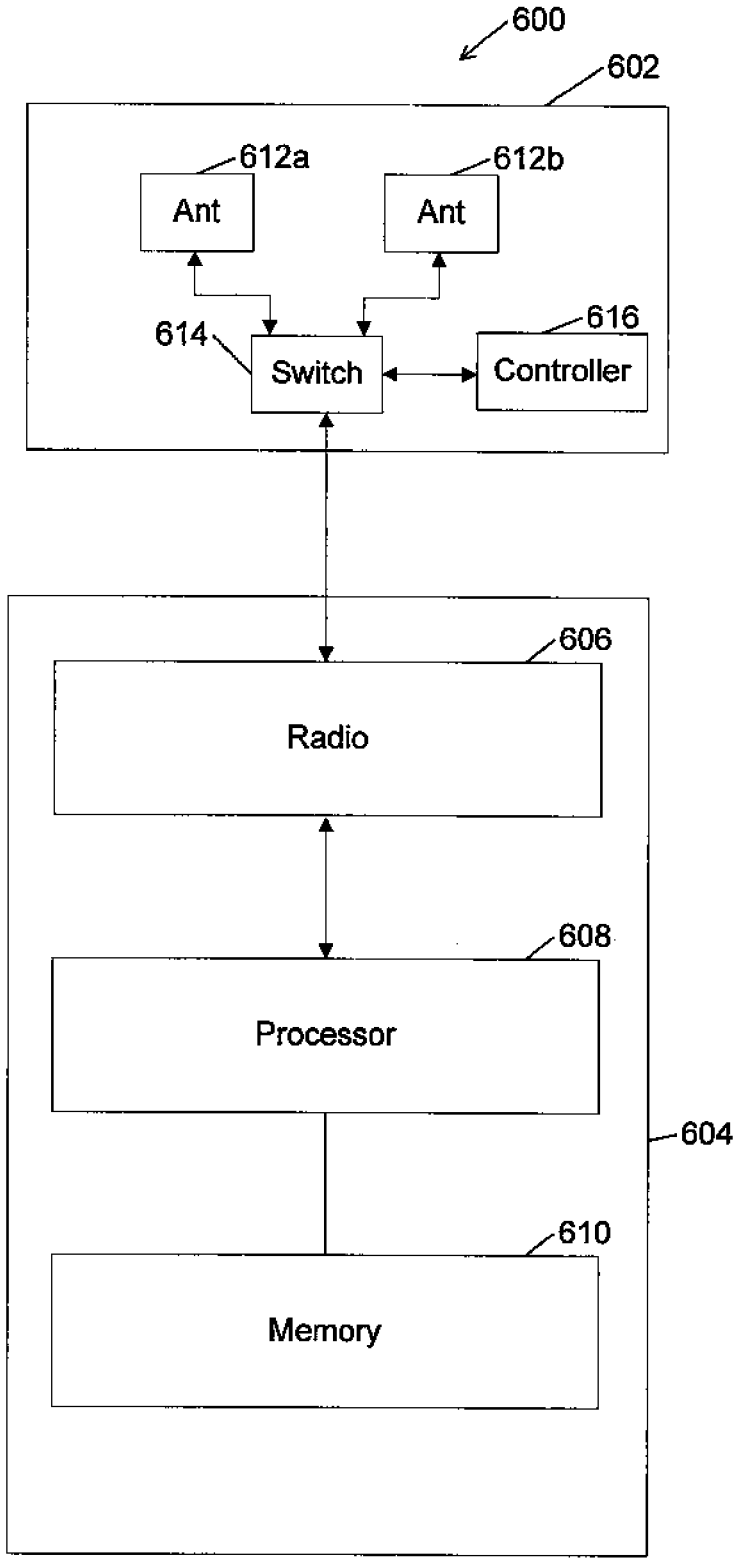
FIG. 6 is a functional block diagram of another embodiment of a wireless communication device that may use a dual-band antenna, such as the dual-band antenna illustrated in FIG. 1.

FIG. 6 is a functional block diagram of another embodiment of a wireless communication device 600 that may use a dual-band antenna, such as the dual-band antenna illustrated in FIG. 1. The wireless device 600 can be, for example, a wireless router, a mobile access point, a wireless network adapted, or other type of wireless communication device. In the embodiment of FIG. 6, the communication device 600 includes a dual-band antenna system 602 which is in communication with a radio system 604. In the example of FIG. 6, the radio system 604 includes a radio module 606, a processor module 608, and a memory module 610. The radio module 606 is in communication with the processor module 608. The radio module 606 generates radio signals which are transmitted by the dual-band antenna system 602 and receive radio signals from the antenna system.

The processor module 608 may implement some or all of the media access control (MAC) functions for the radio system 604 and control the operation of the radio module 606. In general, MAC functions operate to allocate available bandwidth on one or more physical channels on transmissions to and from the communication device 600. The MAC functions can allocate the available bandwidth between the various services depending upon the priorities and rules imposed by their QoS. In addition, the MAC functions can operate to transport data between higher layers, such as TCP/IP, and a physical layer, such as a physical channel. The association of the functions described herein to specific functional blocks in the figure is only for ease of description. The various functions can be moved amongst the blocks, shared across blocks and grouped in various ways. The processor is also in communication with a memory module 610 which can store code that is executed by the processing module 608 during operation of the device 600 as well as temporary store during operation.

In the example of FIG. 6, the dual-band antenna 602 includes a first antenna 612*a* that radiates in a first direction and a second antenna 612*b* that radiates in a second direction different that the first direction. In the example illustrated in FIG. 6, the dual-band antenna radiates in two different directions, in other embodiments, the dual-band antenna may be configured to radiate in more than two directions. The dual-band antenna 602 also includes a switch 614 and a control module 616. In one embodiment, the switch is in communication with the first and second antennas 612*a* and 612*b* and the radio module 614 to communicate signals to and from the radio to a selected one of the antennas 612 a or 612*b*. Operation of the switch is controlled by control module 616. For example, the control module 616 may receive an indication, or feedback, from the switch 624 or the radio system 604, indicating a desired antenna 612*a* or 612*b* to be used. In response to the feedback, the control module 616 can control the operation of the switch.

Figure 7:
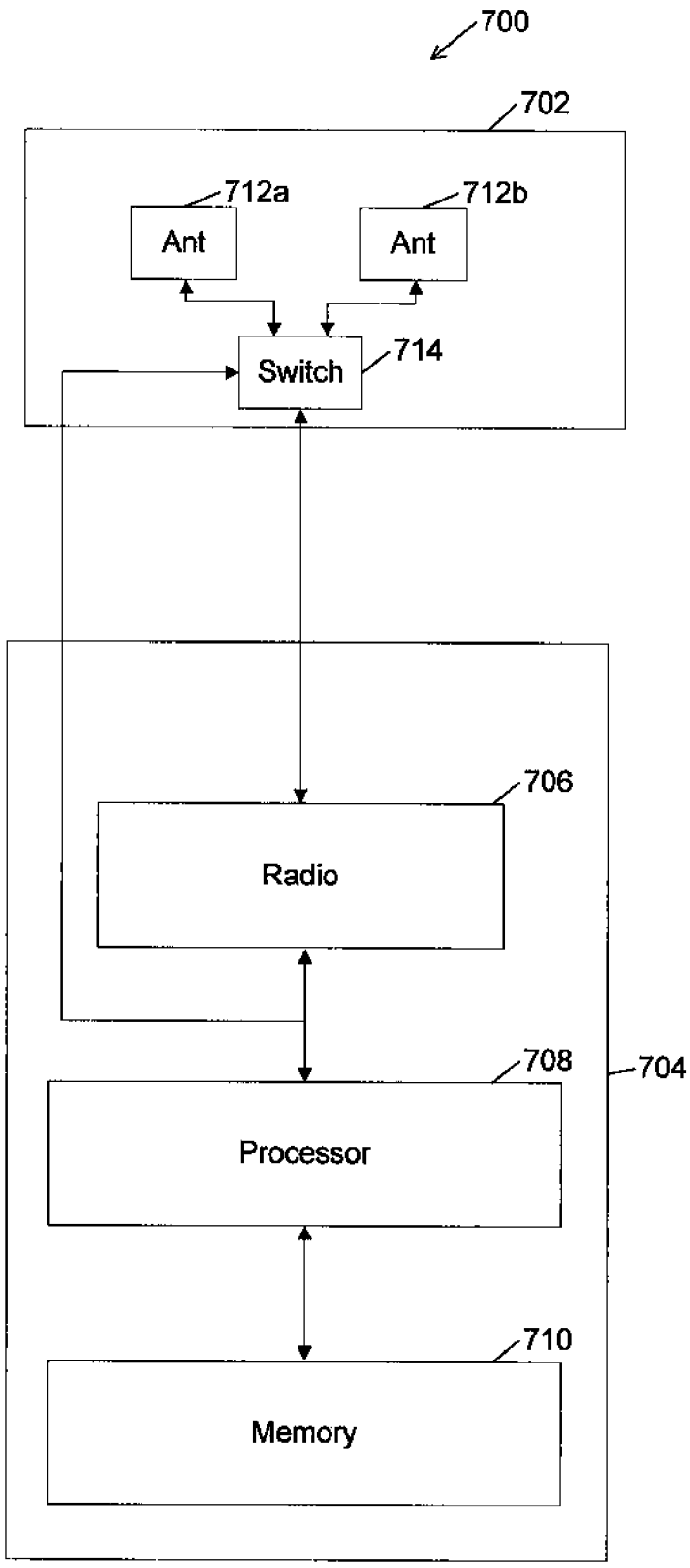
FIG. 7 is a functional block diagram of yet another embodiment of a wireless communication device that may use a dual-band antenna, such as the dual-band antenna illustrated in FIG. 1.

FIG. 7 is a functional block diagram of yet another embodiment of a wireless communication device 700 that may use a dual-band antenna, such as the dual-band antenna illustrated in FIG. 1. The wireless device 700 can be, for example, a wireless router, a mobile access point, a wireless network adapted, or other type of wireless communication device. In the embodiment of FIG. 7, the communication device 700 includes a dual-band antenna system 702 which is in communication with a radio system 704. In the example of FIG. 7, the radio system 704 includes a radio module 706, a processor module 708, and a memory module 710. The radio module 706 is in communication with the processor module 708. The radio module 706 generates radio signals which are transmitted by the dual-band antenna system 702 and receive radio signals from the antenna system.

In the example of FIG. 7, the dual-band antenna 702 includes a first antenna 712*a* that radiates in a first direction and a second antenna 712*b* that radiates in a second direction different that the first direction and a switch 714. In the example illustrated in FIG. 7, the dual-band antenna radiates in two different directions, in other embodiments, the dual-band antenna may be configured to radiate in more than two directions. In one embodiment, the switch 714 is in communication with the first and second antennas 712*a* and 712*b* and the radio module 704 to communicate signals to and from the radio to a selected one of the antennas 712*a* or 712*b*. Operation of the switch is controlled by processor module 708.

Operation of the switch 714 can be to select one of the antennas 712*a* or 712*b* in response to a signal quality metric, such as received signal strength. In one embodiment, the signal metric can be communicated from the radio 706 to the processor module 708 and the processor module 706 operates the switch 714 to select a desired antenna 712*a* or 712*b*.

Various characteristics of the antenna have been described in embodiments herein. by way of example in terms of parameters such as wavelengths and frequency. It should be appreciated that the examples provided describe aspects that appear electrically to exhibit a desired characteristic.

The above description of the disclosed embodiments is provided to enable any person skilled in the art to make or use the invention. Numerous modifications to these embodiments would be readily apparent to those skilled in the art, and the principals defined herein can be applied to other embodiments without departing from the spirit or scope of the invention. Thus, the invention is not intended to be limited to the embodiment shown herein but is to be accorded the widest scope consistent with the principal and novel features disclosed herein.

The various illustrative logical blocks, modules, and circuits described in connection with the embodiments disclosed herein can be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor can be a microprocessor, but in the alternative, the processor can be any processor, controller, microcontroller, or state machine. A processor can also be implemented as a combination of computing devices, for example, a combination of a DSP and a microprocessor, a plurality of microprocessors, one or more microprocessors in conjunction with a DSP core, or any other such configuration.

The steps of a method or algorithm described in connection with the embodiments disclosed herein can be embodied directly in hardware, in a software module executed by a processor, or in a combination of the two. A software module can reside in RAM memory, flash memory, ROM memory, EPROM memory, EEPROM memory, registers, hard disk, a removable disk, a CD-ROM, or any other form of storage medium. An exemplary storage medium can be coupled to the processor such the processor can read information from, and write information to, the storage medium. In the alternative, the storage medium can be integral to the processor. The processor and the storage medium can reside in an ASIC.

Furthermore, those of skill in the art will appreciate that the various illustrative logical blocks, modules, circuits, and method steps described in connection with the above described figures and the embodiments disclosed herein can often be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled persons can implement the described functionality in varying ways for each particular application, but such implementation decisions should not be interpreted as causing a departure from the scope of the invention. In addition, the grouping of functions within a module, block, circuit or step is for ease of description. Specific functions or steps can be moved from one module, block or circuit to another without departing from the invention.

The invention claimed is:

1. An antenna system comprising:

a dual-band strip line monopole element that includes a radio frequency choke located at one end of the clement above a lower portion of the element, wherein an overall length of the monopole element is selected so as to resonate at a first desired frequency, and the length of the lower portion of the monopole element is selected to resonate at a second desired frequency;

a first reflector element located at a distance from the monopole element corresponding to a reflective distance of the first desired frequency, wherein a length of the first reflector element is selected so as to resonate at the first desired frequency; and a second reflector element located between the monopole element and the first reflector, wherein the second reflector element is located at a distance from the monopole element corresponding to a reflective distance of the second desired frequency, and the second reflector element has a length selected so as to resonant at the second desired frequency.

2. The antenna system of claim 1, wherein a ratio of the second desired frequency to the first desired frequency is a non-integer value.

3. The antenna system of claim 1, wherein a ratio of the second desired frequency to the first desired frequency is greater than about 2.

4. The antenna system of claim 1, wherein the first desired frequency is about 2.4 GHz and the second desired frequency is about 5 GHz.

5. The antenna system of claim 1, wherein the radio frequency choke has a high impedance at the second desired frequency.

6. The antenna system of claim 1, wherein the radio frequency choke comprises coplanar waveguide stub.

7. The antenna system of claim 1, wherein the radio frequency choke comprises a lumped radio frequency choke.

8. The antenna system of claim 1, wherein the overall length of the monopole element is about a quarter of a wavelength of the first desired frequency.

9. The antenna system of claim 1, wherein the reflective distance of the first desired frequency is about a quarter of a wavelength of the first desired frequency.

10. The antenna system of claim 1, wherein the overall length of the lower portion of the monopole element is about a quarter of a wavelength of the second desired frequency.

11. The antenna system of claim 1, wherein the reflective distance of the second desired frequency is about a quarter of a wavelength of the second desired frequency.

12. An antenna system comprising:

a first and a second dual-band strip line monopole elements, each monopole element comprises a radio frequency choke located at one end of the element above a lower portion of the element, wherein an overall length of the monopole clement is selected so as to resonate at a first desired frequency, and a length of the lower portion of the monopole element is selected so as to resonate at a second desired frequency:

a common reflector element located between the first and second monopole elements, and at a distance from each of the monopole elements corresponding to a reflective distance of the first desired frequency, wherein a length of the common reflector element is selected so as to resonate at the first desired frequency; and a first and a second reflector elements, wherein the first reflector element is located between the first monopole element and the common reflector and the second reflector element is located between the second monopole element and the common reflector, wherein the first and second reflector elements are each located at a distance corresponding to a reflective distance of the second desired frequency from the first and second monopole elements respectively, and each of the first and second reflector elements has a length selected so as to resonate at the second desired frequency.

13. The antenna system of claim 12, wherein a ratio of the second desired frequency to the first desired frequency is a non-integer value.

14. The antenna system of claim 12, wherein a ratio of the second desired frequency to the first desired frequency is greater than about 2.

15. The antenna system of claim 12, wherein the first desired frequency is about 2.4 GHz and the second desired frequency is about 5 GHz.

16. The antenna system of claim 12, wherein the overall lengths of the monopole elements are about a quarter of a wavelength of the first desired frequency.

17. The antenna system of claim 12, wherein the reflective distance of the first desired frequency is about a quarter of a wavelength of the first desired frequency.

18. The antenna system of claim 12, wherein the overall length of the lower portion of the monopole element is about a quarter of a wavelength of the second desired frequency.

19. The antenna system of claim 12, wherein the reflective distance of the second desired frequency is about a quarter of a wavelength of the second desired frequency.

20. The antenna system of claim 12, wherein the length of the common reflector is selected to be about a quarter of a wavelength of the first desired frequency.

21. The antenna of claim 12, wherein the length of the first and second reflectors is selected to be about a quarter of a wavelength of the second desired frequency.

22. The antenna system of claim 12, wherein the first monopole element and the common reflector radiate are configured to an RF beam at a frequency of about the first desired frequency in a first direction, the first monopole element and the first reflector are configured to radiate an RF beam at a frequency of about the second desired frequency in the first direction, the second monopole element and the common reflector are configured to radiate an RF beam at a frequency of about the first desired frequency in a second direction, and the second monopole element and the second reflector are configured to radiate an RF beam at a frequency of about the second desired frequency in the second direction.

23. The antenna system of claim 12, further comprising a cardbus card.

24. The antenna system of claim 12, further comprising a PCMCIA card.

25. The antenna system of claim 12, wherein the radio frequency choke comprises coplanar waveguide stub.

26. The antenna system of claim 12, wherein the radio frequency choke comprises a lumped radio frequency choke.

27. The antenna system of claim 12, further comprising a radio module comprising a plurality of radios, wherein a first radio is communicatively coupled to the first monopole element and a second radio is communicatively coupled to the second monopole element.

28. An antenna system comprising:

a dual-band strip line monopole element comprising a radio frequency choke located at one end of the element above a lower portion of the element, wherein an overall length of the element is selected to be about a quarter of a wavelength a first desired frequency and a length of the lower portion of the monopole element is selected to be about a quarter of a wavelength of a second desired frequency;

a first reflector element located at a distance from the monopole element corresponding to a distance about a quarter of a wavelength of the first desired frequency, wherein a length of the first reflector element is about a quarter of a wavelength of the first desired frequency: and a second reflector element located between the monopole element and the first reflector wherein the second reflector element is located at a distance from the monopole element corresponding to a distance about a quarter of a wavelength of the second desired wherein a length of the second reflector element is about a quarter of a wavelength of the second desired frequency.

29. The antenna system of claim 28, wherein the first desired frequency is about 2.4 GHz and the second desired frequency is about 5 GHz.

30. The antenna system of claim 28, wherein the radio frequency choke comprises coplanar waveguide stub.

31. An antenna system comprising:

a first and a second dual-hand strip line monopole elements, each monopole element comprising a radio frequency choke located at one end of the element and a lower portion of the element, wherein an overall length of the stub and element is selected to be about a quarter of a wavelength of a first desired frequency, and a length of the lower portion of the monopole element is selected to be about a quarter of a wavelength of a second desired frequency;

a common reflector element located between the first and second monopole elements, wherein the common reflector is a distance of about a quarter of a wavelength from each of the monopole elements, and a length of the common reflector element is about a quarter of a wavelength of the first desired frequency; and a first and a second reflector elements, wherein the first reflector element is located between the first monopole element and the common reflector and the second reflector element is located between the second monopole element and the common reflector, wherein the first and second reflector elements are each located at a distance of about a quarter of a wavelength of the second desired frequency from the first and second monopole elements respectively, and each of the first and second reflector elements has a length of about a quarter of a wavelength of the second desired frequency.

32. The antenna system of claim 31, wherein a ratio of the second desired frequency to the first desired frequency is a non-integer value.

33. The antenna system of claim 31, wherein the radio frequency choke comprises coplanar waveguide stub.

34. The antenna system of claim 31, wherein the first desired frequency is about 2.4 GHz and the second desired frequency is about 5 GHz.

35. The antenna system of claim 31, wherein the first monopole clement and the common reflector are configured to radiate an RF beam at a frequency of about the first desired frequency in a first direction, the first monopole element and the first reflector are configured to radiate an RF beam at a frequency of about the second desired frequency in the first direction, the second monopole element and the common reflector arc configured to radiate an RF beam at a frequency of about the first desired frequency in a second direction, and the second monopole element and the second reflector are configured to radiate an RF beam at a frequency of about the second desired frequency in the second direction.

36. The antenna system of claim 31, further comprising a cardbus card.

37. The antenna system of claim 31, further comprising a PCMCIA card.

38. The antenna system of claim 31, further comprising a radio module which transmits and receives radio frequency signals;

a switch which controllable couples the radio module to the first or the second monopole elements.

39. A method of varying a pattern of an antenna having a first dual-hand strip line monopole clement reflectively coupled to a first and a second reflector and a second dual-band strip line monopole element reflectively coupled to the first and a third reflector, the method comprising:

applying a first signal at a desired frequency to the first dual-band strip line monopole element, wherein a frequency of the signal is selected to cooperate with, and reflect from one of the first and second reflectors to thereby radiate a radio frequency signal in a first direction; and applying a second signal at a desired frequency to the second dual-band strip line monopole element, wherein a frequency of the signal is selected to cooperate with, and reflect from one of the first and third reflectors to thereby radiate a radio frequency signal in a second direction.

* * * * *